US009131572B2

(12) United States Patent
Laulanet et al.

(10) Patent No.: US 9,131,572 B2
(45) Date of Patent: Sep. 8, 2015

(54) METHOD OF FORMING A SEMICONDUCTOR DEVICE AND STRUCTURE THEREFOR

(71) Applicant: Semiconductor Components Industries, LLC, Phoenix, AZ (US)

(72) Inventors: Francois Laulanet, Neder-Over-Heembeek (BE); Wim Van de Maele, Bissegem (BE)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/263,079

(22) Filed: Apr. 28, 2014

(65) Prior Publication Data

US 2014/0346956 A1 Nov. 27, 2014

Related U.S. Application Data

(60) Provisional application No. 61/827,646, filed on May 26, 2013.

(51) Int. Cl.
*G05F 1/00* (2006.01)
*H05B 33/08* (2006.01)

(52) U.S. Cl.
CPC ..... *H05B 33/0842* (2013.01); *H05B 33/0827* (2013.01)

(58) Field of Classification Search
CPC ..... H05B 37/02
USPC ..... 315/312, 291, 294, 307, 308
See application file for complete search history.

(56) References Cited

U.S. PATENT DOCUMENTS

2011/0128303 A1* 6/2011 Yonemaru et al. ..... 345/690
2011/0133645 A1* 6/2011 Kuo et al. ..... 315/77
2012/0126703 A1* 5/2012 Jung et al. ..... 315/122
2013/0038227 A1* 2/2013 Yan et al. ..... 315/186

OTHER PUBLICATIONS

Maxim, "High-Voltage, Linear High-Brightness LED Driver with Open LED Detection", MAX16839, Data Sheet, (c) 2009 Maxim Integrated Products, 12 pages.
Maxim, "High-Voltage, 3-channel Linear High-Brightness LED Driver with Open LED Detection", MAX16823, Data Sheet, (c) 2011 Maxim Integrated Products, 11 pages.
Allegro MicroSystems LLC, "A6260 High Brightness LED Current Regulator", Data Sheet, Copyright 2006-2013, Allegro MicroSystems, LLC, 12 pages.
Allegro MicroSystems LLC, "A6264 Automotive Stop/Tail LED Array Driver", Data Sheet, Copyright 2009-2013, Allegro MicroSystems, LLC, 12 pages.

* cited by examiner

*Primary Examiner* — Minh D A
(74) *Attorney, Agent, or Firm* — Robert F. Hightower

(57) ABSTRACT

In one embodiment, a method of forming an LED control circuit may include configuring the LED control circuit to receive a sense signal that is representative of a value of an LED current flow through a plurality of LED strings wherein each LED string includes a plurality of series coupled LEDs; configuring a detector circuit of the LED control circuit to detect the LED current being no greater than a first value and responsively initiate forming a first time period; and configuring the LED control circuit to inhibit forming the LED current responsively to termination of the first time period.

20 Claims, 5 Drawing Sheets

METHOD OF FORMING A SEMICONDUCTOR DEVICE AND STRUCTURE THEREFOR

PRIORITY CLAIM TO PRIOR PROVISIONAL FILING

This application claims priority to prior filed Provisional Application No. 61/827,646 entitled "METHOD OF FORMING A SEMICONDUCTOR DEVICE AND STRUCTURE THEREFOR" filed on May 26, 2013, and having common inventors Francois Laulanet et al. which is hereby incorporated herein by reference

BACKGROUND OF THE INVENTION

The present invention relates, in general, to electronics, and more particularly, to semiconductors, structures thereof, and methods of forming semiconductor devices.

In the past, the electronics industry utilized various circuits and methods to control light sources such as light emitting diodes (LEDs). In some cases, the prior circuits included elements to detect an open circuit error condition in one LED of the LED system or an open circuit condition in one string of series connected LEDs. However, it generally was not economically feasible to detect such errors in a variable number of multiple strings of series connected LEDs or to detect other error conditions.

Accordingly, it is desirable to have a circuit and method that can perform at least one of detect errors in multiple strings of series connected LEDs, that can detect other errors in addition to an open circuit in one LED or in one LED string, that minimizes the number of pins on a semiconductor package for sensing the error condition, that minimizes the number of detection blocks needed to detect the error condition, and that reduces the cost for detecting the error condition.

Figure 1:
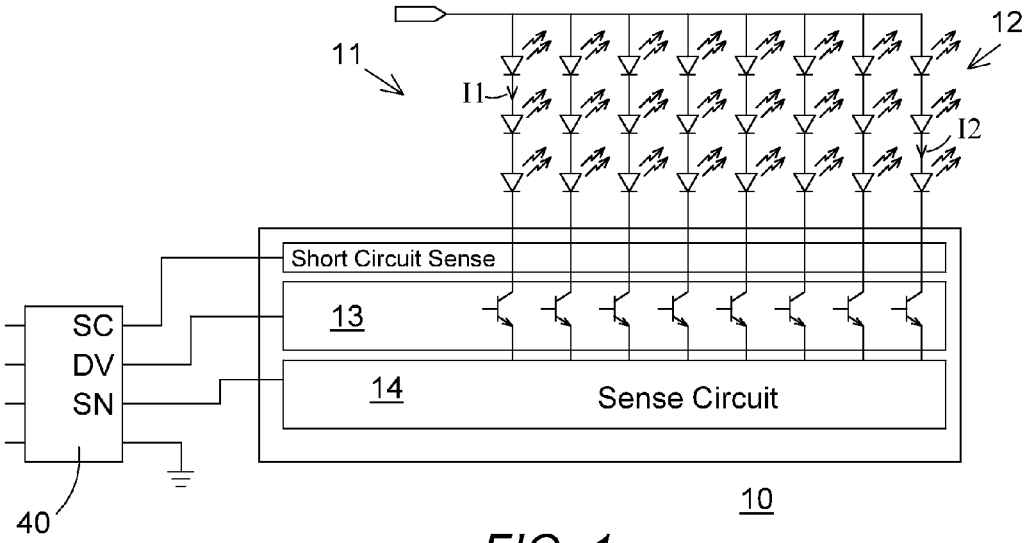
FIG. 1 schematically illustrates an example of an embodiment of a portion of an LED system that includes an LED control circuit in accordance with the present invention.

For simplicity and clarity of the illustration(s), elements in the figures are not necessarily to scale, and the same reference numbers in different figures denote the same elements, unless stated otherwise. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, and that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION OF THE DRAWINGS

FIG. 1 schematically illustrates an example of an embodiment of a portion of an LED system 10 that includes an LED control circuit 40. System 10 includes a plurality of LED strings such as a string 11 that includes a plurality of series connected LEDs and a string 12 that includes another plurality of series connected LEDs. Strings 11 and 12 are illustrated in a general manner by arrows. An example embodiment includes that system 10 may include between one and eight strings.

System 10 also includes a driver circuit or driver 13 that includes a plurality of drivers with one driver for each string, such as one for string 11 and a separate one for string 12. Circuit 40 is configured to form a driver signal (DV) to drive the drivers of circuit 13. An embodiment of circuit 40 includes that circuit 40 has one driver signal (DV) to drive all of the drivers of driver 13. The drivers are illustrated in FIG. 1 as bipolar transistors but the drivers may be other circuits in other embodiments such as MOSFETs or the drivers may also include amplifiers or other circuitry. A sense circuit 14 of system 10 is used to form a sense signal (SN) that is representative of a load current or LED current or current that flows through each LED string, such as a current I1 that flows through string 11 or a current I2 that flows through string 12. Circuit 40 is configured to receive the SN signal and use the SN signal to regulate the value of the LED current, such as the value of currents I1 and I2. An embodiment of circuit 40 includes that circuit 40 has one input to receive the sense signal (SN) that is representative of the LED current of all of the strings. In one embodiment, circuit 40 is configured to regulate the value of the LED current of each string to a substantially constant value. Another embodiment may include that circuit 40 is configured to regulate the value of the LED current of each string to a substantially constant value responsively to the SN signal.

System 10 may also include an optional short circuit sense circuit that is configured to detect a short in an LED string or in driver 13 to the supply voltage. For example, in one embodiment it may be configured to form a short (SC) signal representing a short of a collector of the driver transistors to the supply voltage. An embodiment of circuit 40 may also include forming circuit 40 to receive a short circuit (SC) signal from the short circuit sense circuit.

One embodiment of a method of forming circuit 40 comprises: configuring LED control circuit 40 to control an LED current, such as for example current I1 or I2, through a plurality of LED strings wherein each LED string includes a plurality of series coupled LEDs; configuring the LED control circuit to detect the LED current, such as for example the LED current of any one of or any number of the plurality of strings, being no greater than a first value and responsively initiate forming a first time period; and configuring the LED controller to inhibit forming the LED current responsively to termination of the first time period.

In another embodiment, the method includes configuring LED control circuit 40 to regulate the LED current to a desired value or target value in the absence of an error condition.

Another embodiment of the method includes configuring LED control circuit 40 to inhibit forming the LED current responsively to termination of the first time period and the LED current remaining no greater than the first value for the first time period.

In another embodiment, the method may include configuring LED control circuit 40 to receive a signal sense signal (SN) that is representative of the LED current through all of the plurality of LED strings.

In another embodiment, the method may include configuring LED control circuit 40 to form a single driver signal (DV) to control or to regulate the LED current through all of the plurality of LED strings to a desired value.

Figure 2:
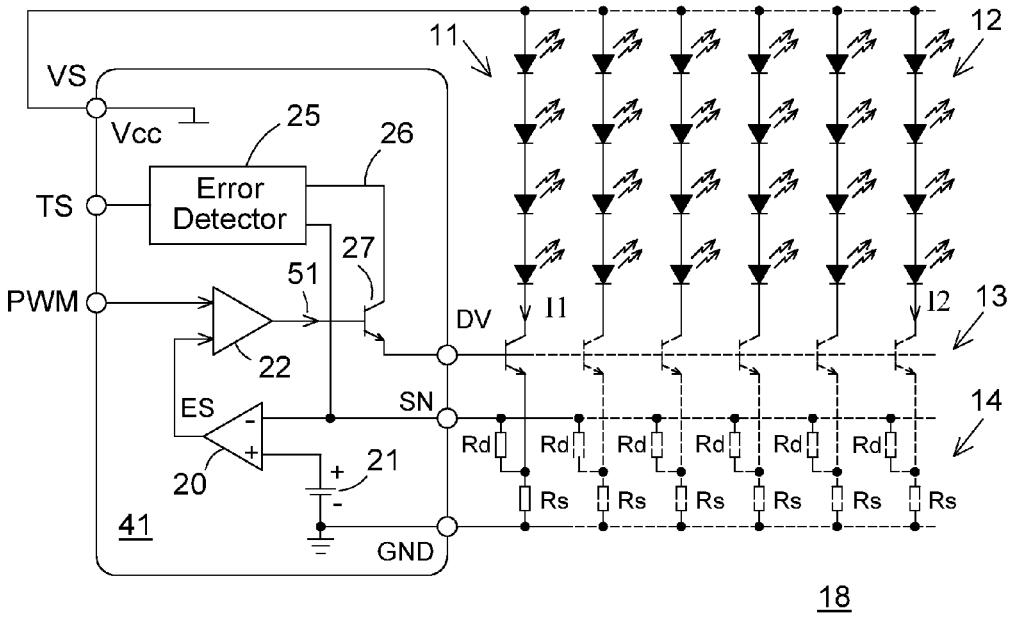
FIG. 2 schematically illustrates an example of an embodiment of a portion of another LED system that is an alternate embodiment of the LED system of FIG. 1 in accordance with the present invention.

FIG. 2 schematically illustrates an example of an embodiment of a portion of an LED system 18 that is an alternate embodiment of system 10. An embodiment of system 18 includes an LED control circuit 41 that is an example of an alternate embodiment of circuit 40. In some embodiments, circuit 41 is similar to circuit 40. An embodiment of system 18 includes an example of an alternate embodiment of circuit 14 that is implemented as resistors, such as resistors Rs. Each resistor Rs forms a signal that is representative of the current through the corresponding LED string. An embodiment may include another resistor, such as a resistor Rd, may be used to sum together all of the signals from the plurality of LED strings to form the sense signal (SN). Those skilled in the art will appreciate that other current sense circuits may be used instead of resistors Rs and Rd. For example, a circuit to measure the voltage across the driver circuit may be used. For example, a circuit to measure the emitter to collector voltage (or source drain voltage).

Circuit 41 includes a current regulation loop that uses the sense signal (SN) and an error amplifier 20 to regulate the value of a load current or LED current or current through the strings, such as an LED current I1 and/or I2, to a substantially constant value. In one embodiment, the loop regulates the average value of all of the load currents through the LED strings to a substantially constant value in the absence of an error condition. The load current is regulated to a target value or desired value within a range of values around the target value. For example, the desired value may be one ampere (1 A) and the range of values may be plus or minus ten percent (10%) around the one ampere. Error amplifier 20 is configured to receive the sense signal and form an errors signal (ES) that is representative of the deviation of the LED current from the desired value. In an embodiment, the desired value is represented by a reference signal from a reference 21. An embodiment of the control loop may include a driver amplifier or driver 22 that receives an error signal (ES) from error amplifier 20. In some embodiments, the error signal (ES) may be used to form the driver signal (DV), such as for example directly forming the driver signal (DV). Amplifier 22 increases or decreases a drive signal 51 and/or driver signal DV in response to the error signal (ES) indicating an LED current that is respectively less than or greater than the desired value. Amplifier 22 may be a buffer amplifier that directly forms the driver signal (DV) or an optional transistor 27 may receive signal 51 from amplifier 22 and form the driver signal (DV). In some embodiments, amplifier 22 may receive an optional pulse width modulation (PWM) signal that may be used for dimming the LEDs, or that may be an enable signal used to enable circuit 41 for forming or disable circuit 41 from forming the driver signal (DV). In some embodiments, the desired value is substantially constant but may be modulated by the PWM signal to provide diming of the LEDs. However, the current, when enabled by the PWM signal, is regulated to the desired value.

Circuit 41 is configured to include an error detector circuit 25. In one embodiment, circuit 25 may include an output 26 that is configured to supply a current to transistor 27. Error detector circuit is configured to detect error conditions including multiple error conditions. The error conditions or multiple error conditions may include an open load condition such as the condition of an open circuit in one or more than one of the LEDs or LED strings. As will be seen further hereinafter, the error condition or multiple error conditions may also include one or more various other error conditions including a control electrode of one of the driver transistors shorted to a common return (such as a base electrode shorted to ground return for example), or shorted to another voltage, or may include an open LED or an open wire or an open circuit in one of the drivers of driver 13 corresponding to one of the LED strings. The error conditions may also include the conditions of an open collector or drain (either in a transistor or a connection to the transistor), a shorted emitter or source, an open base or gate (either in a transistor or a connection to the transistor), an open emitter or source (either in a transistor or a connection to the transistor), and/or an open circuit in the SN path to amplifier 20. Circuit 41 is configured to detect the error condition(s) including error conditions in one or more of the LED strings and to initiate an error sequence.

The error sequence may include detecting the error condition(s) and determining the error condition(s) remain(s) for a first time period. As part of an embodiment of the error sequence, circuit 41 is configured to inhibit current flow through the plurality of LED strings responsively to detecting the error condition(s) for no less than the first time period. In another embodiment, a part of the error sequence may include configuring circuit 41 to detect removal of the error condition(s) and maintain inhibiting the current flow through the plurality of LED strings responsively to the error condition(s) being removed for no less than a second time period. In another embodiment, the error sequence may also include configuring circuit 41 to restart the second time period responsively to detecting an error condition, either the original error condition or a different error condition, prior to expiration of the second time period. In another embodiment, the error sequence may include that the second time period is greater than the first time period.

One embodiment of a method of forming circuit 41 may comprise; configuring LED control circuit 41 to receive a sense signal that is representative of a value of an LED current flow through a plurality of LED strings wherein each LED string includes a plurality of series coupled LEDs; configuring detector circuit 25 of the LED control circuit to detect the LED current being no greater than a first value and responsively initiate forming a first time period; and configuring the LED control circuit to inhibit forming the LED current responsively to termination of the first time period.

Another embodiment of the method may include configuring LED control circuit 41 to inhibit forming the LED current responsively to termination of the first time period and the LED current remaining no greater than the first value for the first time period.

In another embodiment, the method may include configuring LED control circuit 41 to regulate the LED current to a desired value in the absence of an error condition.

Another embodiment of the method may include forming the first value to be less than the desired value.

An embodiment may include configuring circuit 41 to regulate the LED current to a desired value wherein the first value is less than the desired value.

Another embodiment may include configuring circuit 41 to receive a single sense signal (SN) that is representative of the value of the LED current through the plurality of LED strings.

Figure 3:
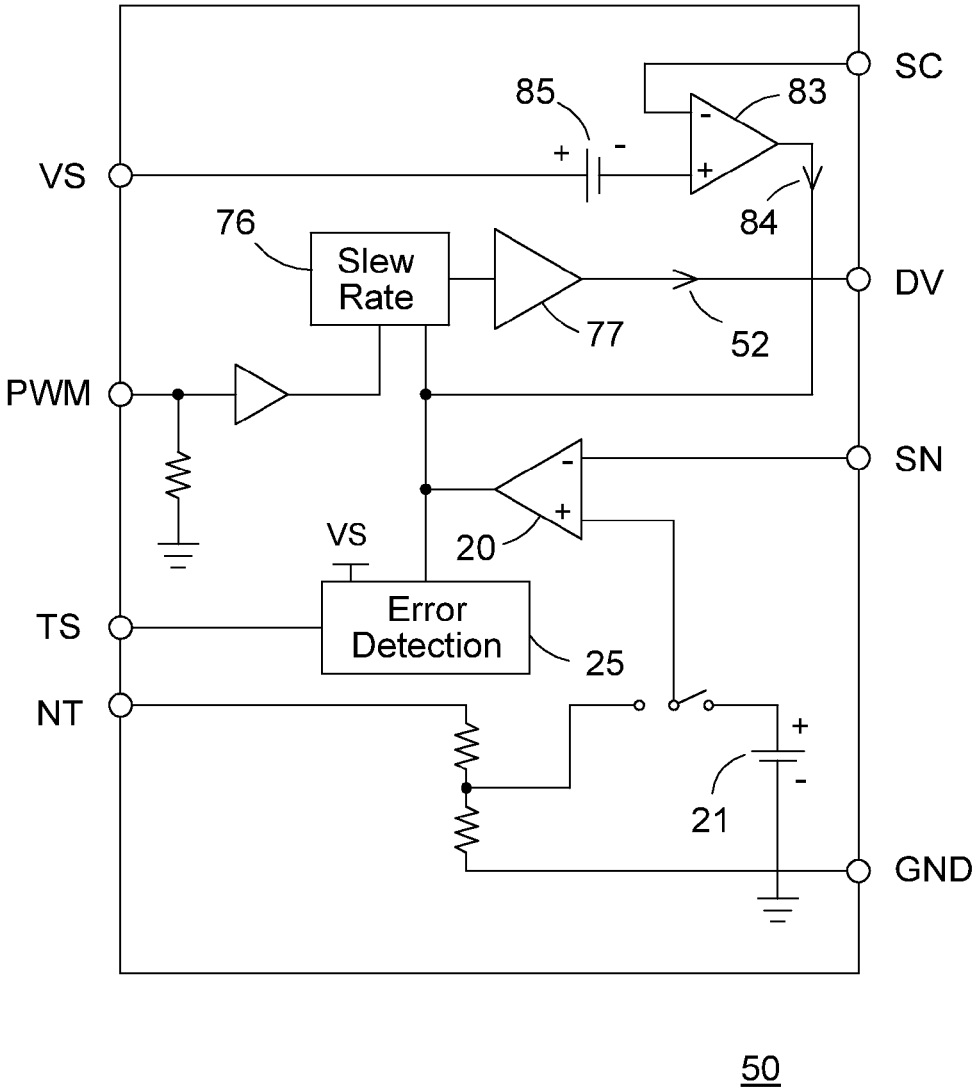
FIG. 3 schematically illustrates an example of an embodiment of a portion of an LED control circuit that is an example of an alternate embodiment of the LED control circuit of FIGS. 1 and 2 in accordance with the present invention.

FIG. 3 schematically illustrates an example of an embodiment of a portion of an LED control circuit 50 that is an example of an alternate embodiment of circuits 40 and 41 that were described in the descriptions of FIGS. 1 and 2. Circuit 50 is similar to circuits 40 and 41 but circuit 50 may include other circuits that may optionally be included in either of circuits 40 and/or 41. Circuit 50 includes a drive circuit or driver 77 that is similar to driver 22. An embodiment includes configuring driver 77 to form a drive signal 52 to control drivers 13, for example form driver signal DV. Drive signal 52 and/or driver signal DV may be a current such as for driving bipolar transistors or may be a voltage such as for driving MOSFETs.

Circuit 50 is configured to detect the short circuit and responsively terminate the LED current(s). An embodiment of circuit 50 may include a short circuit comparator?? 83 that receives the short circuit signal (SC) from the short circuit sense circuit (FIG. 1) and forms a short circuit detect signal 84. Asserting the output of comparator 83 initiates the error sequence. In the illustrated example embodiment, comparator 83 may be configured with an open output, such as an collector (or open drain) output so that asserting the output of comparator 83 causes circuit 50 to form the DV signal with a value that inhibits forming the LED current(s). IN other embodiments, the output of comparator 83 may connected to an input of driver 77 to cause driver 77 to form the DV signal with a value that inhibits forming the LED current(s). In some embodiments, comparator 83 may be configured to compare the SC signal to the supply voltage (signal SC).

In some embodiments, circuit 50 may also include an optional slew rate control circuit 76 that may control the rate of change of signal 52 and/or the driver signal DV. Circuit 50 is also configured to detect the error condition(s) and to initiate the error sequence as described in the description of FIG. 2. Those skilled in the art will appreciate that the explanation of the error sequence described in the description of FIG. 2 referred to circuit 41, however, when applied to circuit 50, the error sequence references to circuit 41 would be replaced by references to circuit 50.

An embodiment of circuit 50 may include an optional timer signal (TS) input that is configured to receive a timer signal. In an embodiment, circuit 50 may also include an optional negative temperature control (NT) input that is configured to receive a signal from a negative temperature coefficient element. The reference signal to amplifier 20 may be selected between the reference signal from reference 21 or a signal that is representative of the NT input signal. For the embodiments that do not include the NT input, amplifier 20 may receive the reference signal from reference 21.

In one embodiment, circuits 40, 41, and 50 are configured to detect the error condition by more than one method. One method includes detecting the LED current being less than the desired value.

In another embodiment, circuit 50 may comprise: a control circuit configured to form a drive signal to control LED current through a plurality of LED strings; an input to receive a sense signal that is representative of the LED currents; an error detector circuit configured to detect the LED current being less than a desired value for a first time period; and the LED control circuit configured to inhibit the LED current responsively to the error detector circuit detecting the LED current being less than the desired value for the first time period.

In another embodiment, the control circuit is configured to continue to inhibit the LED current until expiration of a second time period.

An embodiment may include forming the first time period to be greater than the second time period.

Another embodiment may include forming the second time period to be greater than the first time period.

In order to assist in providing the functionality described herein, the inverting input of amplifier 20 is connected to receive the SN signal and the non-inverting input is connected to receive a signal from a switch having a first terminal coupled to reference 21 and a second terminal coupled to receive a signal representative of a signal on the NT input. An output of amplifier 20 is commonly connected to an input of circuit 25 and an input of driver 77. In an optional embodiment, the output of comparator 20 is coupled to driver 77 through slew rate circuit 76. A PWM input of circuit 50 is connected to another input of driver 77 and optionally is connected to driver 77 through circuit 76. An output of driver 76 is connected to the DVD output of circuit 50. A TS input of circuit 50 is connected to an input of circuit 25.

Figure 4:
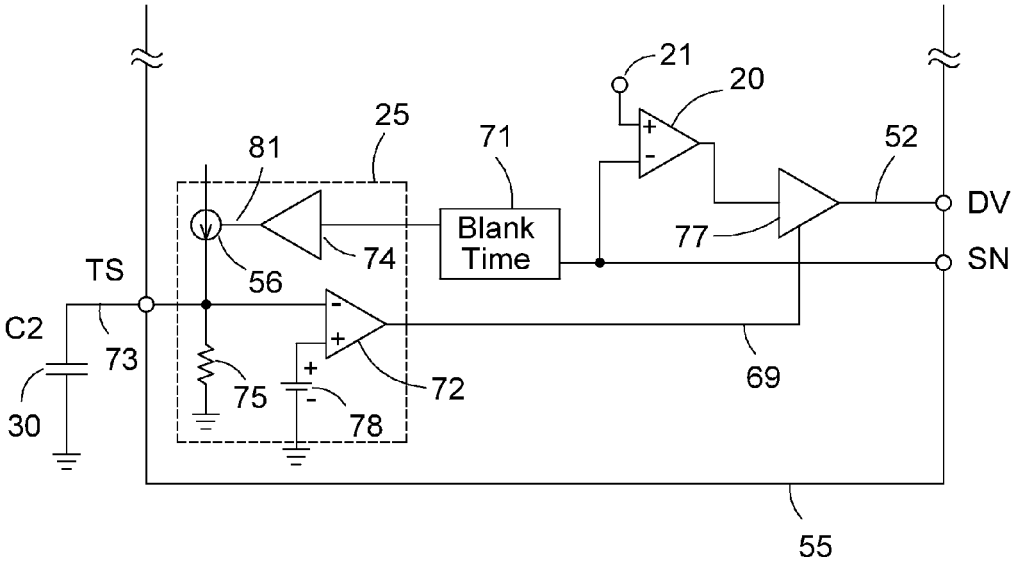
FIG. 4 schematically illustrates an example of an embodiment of a portion of another LED control circuit that is an alternate embodiment of the LED control circuit of FIGS. 1-3 in accordance with the present invention.

FIG. 4 schematically illustrates an example of an embodiment of a portion of an LED control circuit 55 that is an alternate embodiment of circuits 40, 41, and 50. Circuit 55 includes an alternate embodiment of circuit 25. Circuit 55 may be similar to any of or all of circuits 40, 41, and 50. Circuit 55 is configured to form the first and second time periods. In one embodiment, circuit 55 is configured to include a timer circuit. Circuit 25 is configured to detect at least a portion of the error condition(s) and responsively perform the error sequence. In an embodiment, circuit 55 may include an optional blank time circuit or blanking timer 71. During power-up, blanking timer 71 blanks the value of the sense signal (SN) to provide time for the operating voltage to increase to a sufficient operating value which assists in minimizing false error detections.

Some error conditions cause the sense signal (SN) to decrease to a first value. In some embodiments, the first value is representative of an LED current that typically is less than the desired value, For example, the value of the sense signal (SN) will decrease if there is an open circuit in the string of LEDs, or a connection between the string and circuit 13, or in circuit 13 (such as an open collector (drain) open base (gate) open emitter (source), or between circuits 13 and 14, or in the sense signal path including elements within circuit 14 or in the connection to the SN input of circuit 55. In some of the error conditions, the SN path is interrupted which causes the SN signal to decrease, in other conditions, the LED current path is interrupted which causes the SN signal to decrease. Error circuit 25 detects the error condition and initiates the error sequence.

Circuit 55 includes comparators 72 and 74 that in one embodiment may be a portion of circuit 25. For the illustrated example embodiment of circuit 25, comparator 74 receives the SN signal and detects the sense signal (SN) being no greater than the first value and assets an error detect signal or error signal 81. Circuit 25 is configured to initiate forming the first time period responsively to the error condition. In one example embodiment, circuit 25 is configured initiate the first time period responsively to asserting signal 81. A selectively enabled current source 56 is selectively enabled responsively to the sense signal being no greater than the first value. For example, comparator 74 may responsively assert signal 81 which selectively enables source 56 to supply a charging current to a capacitor 30 and initiate forming the first time period. In one embodiment, the voltage on capacitor 30 may be a timer signal 73. In one embodiment, circuit 55 is configured to continue forming the LED currents, such as currents I1 and I2, during the first time period. In an example embodiment, a comparator 72 monitors the value of the voltage on capacitor 30. As capacitor 30 is charging, capacitor 30 is less than an error value thus a signal 69 on the output of comparator 72 is negated which enables driver 77 to form the driver signal DV. In one embodiment the error value is represented by a voltage of a reference 78 to comparator 72. Comparator 72 asserts error signal 69 responsively to the voltage on capacitor becoming substantially the error value which disables driver 77 from forming the DV signal. If the error condition is removed prior to the first time period, comparator 74 disables source 56 and terminates forming the first time period. If the error condition remains after the first time period, comparator 74 continues to charge capacitor 30.

In the event that the error condition is disabled, circuit 25 detects the sense signal becoming no less than the first value and responsively terminates forming the first time period. In one example embodiment, comparator 74 disables source 56 to terminate the charging current to capacitor 30 responsively to detecting that the sense signal becoming no less than the first value. Circuit 25 is configured to initiate forming the second time period responsively to detecting the termination of the first time period. In one embodiment, the negated error signal 81 from comparator 74 selectively disables source 56. Capacitor 30 then begins discharging to form the second time period. The second time period usually is greater than the first time period. Comparator 72 detects the value of capacitor 30 becoming less than the error value and negates signal 69 thereby indicating expiration of the second time period. Negating signal 69 enables driver 77 to again form the driver signal (DV). If an error condition occurs again prior to the expiration of the second time period, comparator 74 begins charging capacitor 30 which extends the second time period and maintains the terminated state of the LED current until expiration of the extended value of the second time period.

Those skilled in the art will appreciate that the explanation of the error sequence in FIG. 2 referred to circuit 41, however, when applied to circuit 55, the error sequence references to circuit 41 would be replaced by references to circuit 55. An embodiment of circuit 55 includes configuring circuit 25 to determine the error condition remaining for no less than the first time period. An embodiment of circuit 55 is configured to inhibit current flow through the plurality of LED strings responsively to detecting the error condition(s) for no less than the first time period. As applied to circuit 55, an embodiment may include that the error sequence may also include that circuit 55 is configured to detect the removal of the error condition and to maintain inhibiting the current flow for a second time period responsively to detecting the removal of the error condition. In one embodiment the error sequence may include that circuit 55 is configured to maintain inhibiting the current flow responsively to the combination of expiration of the first time period and continued detection of the error condition. In another embodiment the error sequence may include that circuit 55 is configured to restart the second time period and maintain inhibiting the current flow responsively to again detecting an error condition prior to expiration of the second time period. Another embodiment of the error sequence may include that circuit 55 is also configured to terminate forming the first time period responsively to detecting the termination of the error condition prior to expiration of the first time period. In one embodiment, the error sequence includes configuring circuit 55 to maintain forming the first time period as long as the error condition remains. In another embodiment the error sequence may also include that circuit 55 is configured to assert an error detection signal 69 responsively to detecting the error condition continuing for no less than the first time period. Another embodiment of the error sequence may include that circuit 55 is configured to restart forming the current flow through the LED strings responsively to termination of the second time period.

In order to assist in providing the functionality described herein, an input of comparator 74 is connected to receive the SN signal from the S in input of circuit 55, or optionally through circuit 71. The output of comparator 74 is connected to a control input of source 56. A first terminal of source 56 is coupled to receive a voltage for operating, and a second terminal is commonly connected to an inverting input of comparator 72 and to the TS input of circuit 55. A non-inverting input of comparator 72 is connected to receive the signal from reference 78. An optional resistor 75 may have a first terminal connected to the TS input and a second terminal connected to a common voltage. The TS input of circuit 55 and is configured to be coupled to a capacitor 30. An output of comparator 72 is connected to an input of driver 77. In one embodiment the output is connected to an enable input of driver 77.

Figure 5:
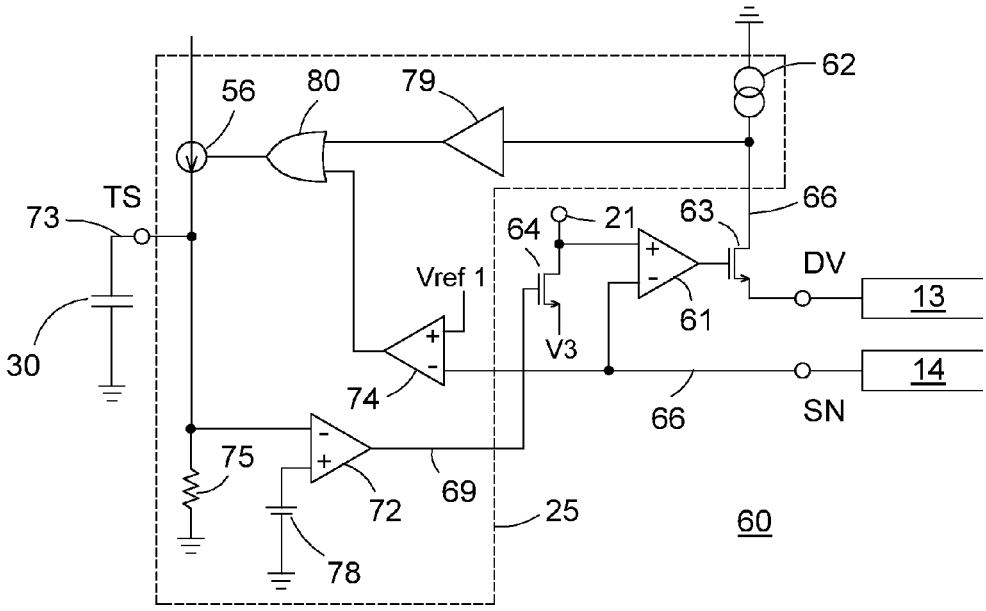
FIG. 5 schematically illustrates an example of an embodiment of a portion of an LED control circuit that is an alternate embodiment of the LED control circuits of FIGS. 1-4 in accordance with the present invention.

FIG. 5 schematically illustrates an example of an embodiment of a portion of an LED control circuit 60 that is an example of an alternate embodiment of circuits 40, 41, 50, and 55. Circuit 60 includes specific example embodiments that are used as a vehicle to explain one example of a more detailed operation of circuit 60. Circuit 60 includes comparators 74 and 79 that in one embodiment may be a portion of circuit 25. A current source 62 may be a portion of another embodiment of circuit 25. In another embodiment, circuit 60 may include an amplifier 61, a current control transistor 63, and a disable transistor 64 that may be configured in an example embodiment to operate as driver 77 of circuit 55 or as driver 22 of circuit 41. In one embodiment, amplifier 61 may be a combination of elements that includes amplifier 20 (FIG. 3). An embodiment may include that transistor 63 is an N-channel MOS transistor, but may be a P-channel or a bipolar transistor, such as for example an NPN bipolar transistor, in other embodiments. In another embodiment, amplifier 20 may be in the path (but not shown in FIG. 5) between the sense signal (SN) and the input to amplifier 61. In another embodiment, amplifier 20 may be omitted and amplifier 61 may perform the function of amplifier 20.

In normal operation, for example in the absence of an error condition, amplifier 61 receives the sense signal and controls transistor 63 to form the drive signal (DV) for drivers 13 which controls the average value of the LED currents to a substantially constant value. For example, to a desired value that is proportional to reference 21. In an embodiment of circuit 60, transistor 63 forms a base drive current for the base of the transistors of drivers 13.

Suppose that any one of the several different error conditions occur. The error conditions may include an open circuit in one or more collector(s) (drain) of drivers 13, an open circuit in the base (or gate) of one or more of drivers 13, an open circuit in the emitter (or source) of one or more of drivers 13, or an open circuit in the sense signal (SN) path to a sense (SN) input 66 of circuit 60. These open circuit conditions may result from an open circuit within the transistors or sense elements or a connection thereto such as a wire or other element forming connections between elements. Additionally, the error condition may include an open circuit condition in any one or more LEDs in one or more LED strings. The error condition may also result from a short in the emitter (or source) such as a short to a common return or to another voltage. When one or more of these conditions occurs, drivers 13 no longer conduct sufficient current to maintain the LED currents at the desired value or at a substantially constant value. Thus, no longer form the sense signal (SN) at the substantially constant value of the sense signal. Circuit 60 supplies increased drive but the sense signal still decreases. Once the sense signal decreases to the first value, which typically is less than the desired substantially constant value, error circuit 25 detects the error condition and initiates the error sequence.

For the illustrated example embodiment of circuit 60, comparator 74 receives the sense signal and detects the sense signal being no greater than the first value. In one example embodiment, decreasing to a value that is no greater than a reference value Vref1. The output of comparator 74 responsively asserts error signal 81 which selectively enables source 56, such as through an OR-gate 80, to supply the charging current to capacitor 30 and initiate forming the first time period. In another embodiment, circuit 55 and/or circuit 60 is configured to continue forming the LED currents, such as currents I1 and I2, during the first time period. Comparator 72 detects the value of the voltage on capacitor 30 reaching the error value and responsively asserts error detection signal 69 indicating the expiration of the first time period. In response to the expiration of the first time period, for example the asserted state of signal 69, circuits 55 and/or 60 disable the drive signal to drivers 13 thereby inhibiting the LED current, such as current I1 for example, and current flow through all of the plurality of LED strings.

Circuit 60 illustrates an example embodiment where signal 69 is used to enable and disable transistor 64. Transistor 64 forces a reference input of amplifier 61 to a low value, such as a value V3, which substantially disables transistor 63 thereby inhibiting the drive signal to drivers 13. The value of V3 typically is less than the value of reference 21. In one embodiment, the value of V3 may be close to the ground reference or alternately may be substantially the same as the ground reference. In other embodiments the value of the drive signal may be changed, such as for example reduced, to a value that substantially inhibits current flow through the LED strings. In one embodiment, the error sequence includes configuring circuit 60 to maintain enabling source 56 and maintain charging capacitor C2 and forming the first time period as long as the error condition remains. Those skilled in the art will appreciate that the first time period and/or the second time period may be formed by various other circuit implementations including a digital counter that is configured to count a number of clock cycles and form signals 69 and 81 responsively to counting the number of cycles.

In the event that the error condition is disabled, comparator 74 detects the sense signal becoming no less than the first value and responsively terminates forming the first time period. Circuit 60 is configured to initiate forming the second time period responsively to detecting the termination of the first time period. Negated error signal 81 from comparator 74, such as through gate 80, selectively disables source 56. Capacitor 30 then begins discharging to form the second time period. The second time period usually is greater than the first time period. Comparator 72 detects the value of capacitor 30 becoming less than the error value and negates signal 69 thereby indicating expiration of the second time period. Negating signal 69 enables amplifier 61 to again form driver signal (DV) to control drivers 13 and control the LED current.

Circuit 60 and circuit 25 are also configured to detect an error condition by more than one method. In some configurations of the LED strings, the SN signal may not decrease to less than the first value in response to some error condition. For example, the plurality of LED strings or a combination of the LED strings and the configuration of circuits 13 or 14 may cause the sense signal to not decrease to no greater than the first value in response to the error condition. For example, an error condition of an open circuit in the LED current path, such as for example an open circuit in the LED string (including an open in an LED) or a collector (drain) of a drive transistor of circuit 13, or an error condition of a short in the control electrode of a drive transistor of circuit 13 may not cause the SN signal to decrease completely to the first value. For such a condition, circuits 40, 41, 50, 55, and 60 are configured to detect a value of drive signal 52 or the driver signal (DV) exceeding a second value and responsively initiate the error sequence. Circuits 40, 41, 50, 55, and 60 are configured to inhibit current flow through the plurality of LED strings responsively to detecting the error condition for no less than the first time period. For such error conditions, the value of the sense signal typically will decrease.

If the value of the sense signal does not decrease to no greater than the first value, circuits 40, 41, 50, 55, and 60 increase the value of signal 52 to attempt to maintain the value the LED current substantially constant, such as to the desired value, until the value of signal 52 or the DV signal is no less than the second value. Circuits 40, 41, 50, 55, and 60 are configured to detect signal 52 or the DV signal being no less than the second value and responsively initiate forming the same error sequence as that described in response to detecting the sense signal being no greater than the first value.

In the example embodiment illustrated in FIG. 5, a comparator 79 is configured to detect the value of drive current supplied to drivers 13 by a current source 62 being no less than the second value, and circuit 25 is configured to responsively initiate forming the error sequence that was described in response to the sense signal being no greater than the first value. The output of comparator 79 is asserted in response to detecting the error condition. The asserted output of comparator 79 asserts the output of OR-gate 80 which enables source 56 to begin charging capacitor 30. Comparator 79 remains negated as explained previously to enable forming the DV signal. If the error condition is removed prior to the first time period, source 56 is disabled. For embodiments of MOS transistors instead of bipolar transistor drivers, circuit 25 may be configured to detect the drive voltage increasing to no less than the second value.

In order to assist in providing the functionality described herein, input 66 is commonly connected to an inverting input of amplifier 61 and an inverting input of comparator 74. A non-inverting input of comparator 74 is connected to Vref1. An output of comparator 74 is connected to a first input of OR-gate 80. An output of gate 80 is connected to the control input of source 56. A gate of transistor 64 is connected to the output of comparator 72. A source of transistor 64 is connected to receive the signal from reference V3 and a drain is connected to a reference 21.

A non-inverting input of amplifier 61 is connected to the drain of transistor 64. An output of amplifier 61 is connected to a gate of transistor 63 which has a source connected to the DV output of circuit 60. A drain of circuit 60 is commonly connected to a first terminal of source 62 and to an input of comparator 79. A second terminal of source 62 is connected to receive operating power. An output of comparator 79 is connected to a second input of gate 80.

Those skilled in the art will appreciate that the hereinbefore descriptions of configuring circuits 40, 41, 50, 55, 60, etc to detect multiple error conditions allows one circuit to detect the multiple errors in any number of LED strings without having to increase the number of circuit elements internal to the circuits and without having to increase the number of sense signals or inputs. Additionally, since there is only one error detector circuit to detect errors in all of the LED strings, the circuit only needs one sense (SN) signal input that is used to sense the current of all of the LED strings. Such functionality reduces costs and provides increased functionality of the system that uses such circuits. Configuring circuits 40, 41, 50, etc to use one pin of a semiconductor package and/or one signal to provide the detection of the multiple error conditions reduces the cost of the semiconductor device that includes one or more of circuits 40, 41, 50, 55, etc and reduces the associated system costs.

Figure 6:
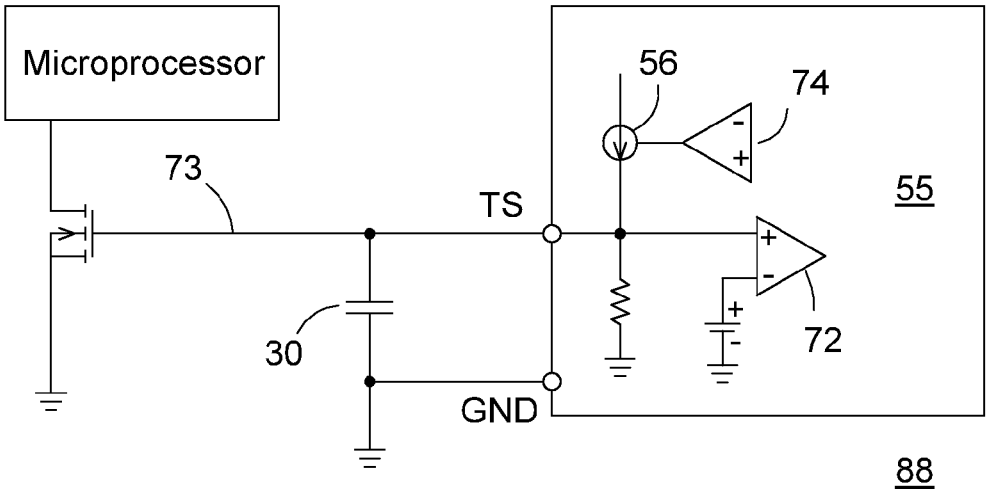
FIG. 6 schematically illustrates an example of an embodiment of a portion of an LED system that is an alternate embodiment of the systems of FIGS. 1-3 in accordance with the present invention.

FIG. 6 schematically illustrates an example of an embodiment of a portion of an LED system 88 that is an alternate embodiment of and is similar to systems 10 and/or 18. System 88 may include an optional microprocessor or other logic or control circuitry (not shown) that receives the timer signal 73. A transistor may be coupled to receive timer signal 73 and send a corresponding signal to the microprocessor. The transistor buffers the microprocessor from circuit 40. In an alternate embodiment, signal 73 may be connected directly to the microprocessor or other logic or control circuitry.

Figure 7:
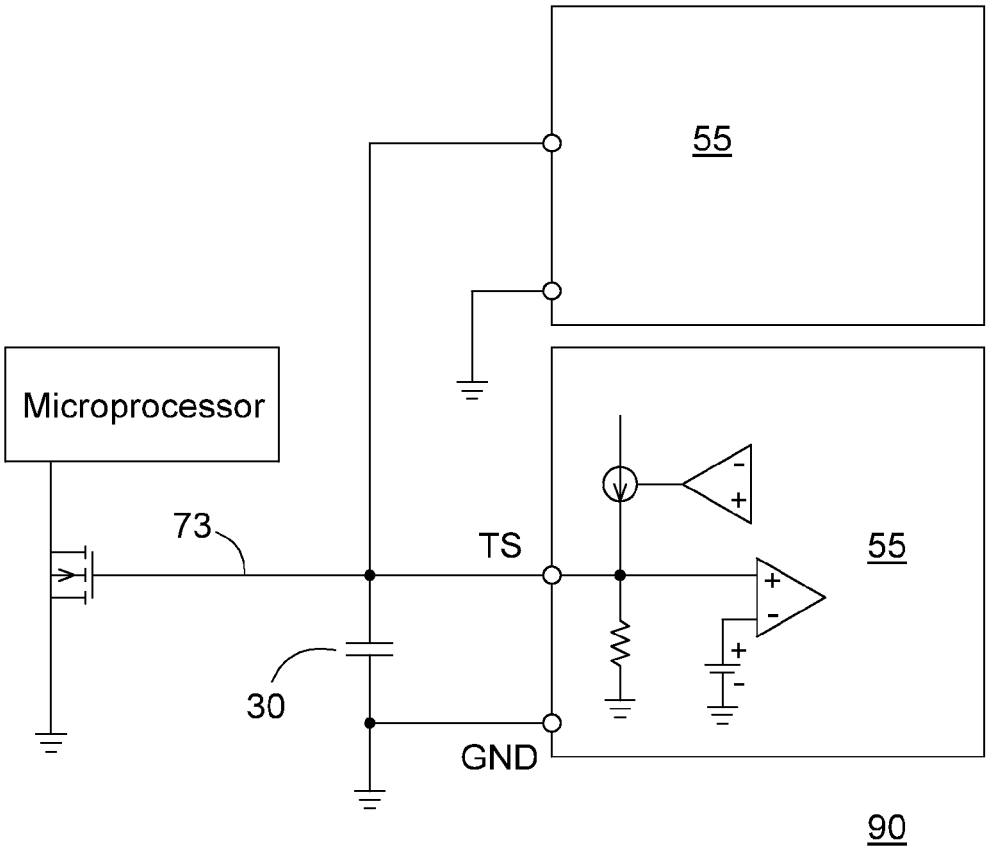
FIG. 7 schematically illustrates an example of an embodiment of a portion of another LED system that is an alternate embodiment of the systems of FIGS. 1-3 and 6 in accordance with the present invention.

FIG. 7 schematically illustrates an example of an embodiment of a portion of an LED system 90 that is an alternate embodiment of and is similar to systems 10, 18, and 88. System 90 include multiple LED control circuits such as multiple circuits 40, 41, 50, 55, and/or 60 and forms one timer signal 73 that detects one or both of circuits 50 detecting the error condition. In this embodiment, the two signals 73 from each of the LED control circuits is ORed together to form a composite timer signal 73.

Figure 8:
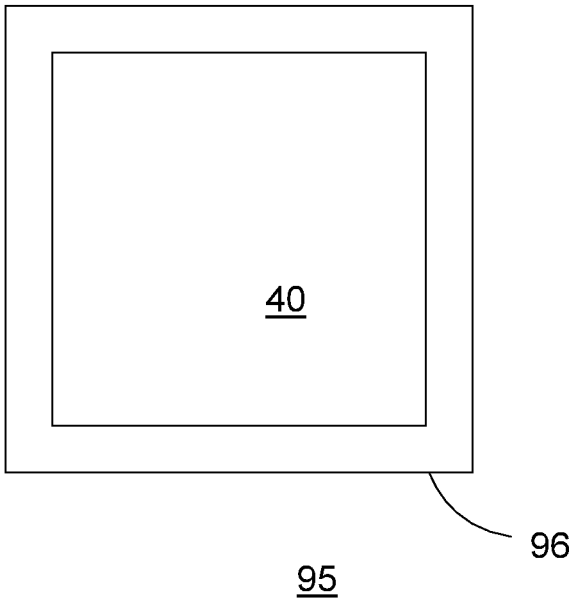
FIG. 8 illustrates an enlarged plan view of a semiconductor device that includes at least one of the LED control circuits of FIGS. 1-7 in accordance with the present invention.

FIG. 8 illustrates an enlarged plan view of a portion of an embodiment of a semiconductor device or integrated circuit 95 that is formed on a semiconductor die 96. Any of circuits 40, 41, 50, 55, and/or 60 may be formed on die 96. Die 96 may also include other circuits that are not shown in FIG. 8 for simplicity of the drawing. Controller 50 and device or integrated circuit 95 are formed on die 96 by semiconductor manufacturing techniques that are well known to those skilled in the art.

Those skilled in the art will appreciate that in one embodiment, an LED control circuit may comprise:

a control circuit, such as for example circuit 40 or any one of circuits 41/50/55/60, configured to form a drive signal, such as signal DV for example, to control LED current through a plurality of LED strings;

an input, for example input SN, to receive a sense signal, such as signal SN for example, that is representative of the LED current;

an error detector circuit, such as circuit 25 for example, configured to detect the LED current being less than a desired value for a first time period, such as a charging time of capacitor 30 for example; and the LED control circuit configured to inhibit the LED current responsively to the error detector circuit detecting the LED current being less than the desired value for the first time period.

In another embodiment, the LED control circuit may be configured to continue to inhibit the LED current until expiration of a second time period, such as for example a discharge time of capacitor 30.

Another embodiment may include that the error detector circuit is configured to form the second time period responsively to termination of the first time period.

In an embodiment, the error detector circuit may include a first comparator, such as a comparator 74 for example, configured to detect the sense signal being no greater than a first value and responsively initiate forming the first time period.

An embodiment may include that the first comparator initiates the first time period by selectively enabling a current source to charge a capacitor.

Another embodiment may include that the error detector circuit includes a second comparator, such as a comparator 79 for example, configured to detect the drive signal being no less than a second value and responsively initiate forming the first time period.

In an embodiment, the error detector circuit may detect the LED current being less than the desired value and responsively initiates forming the first time period, the error detector circuit configured to assert an error detection signal, such as a signal 69 for example, responsively to the LED current being less than the desired value for the first time period wherein the control circuit receives the error detection signal and responsively disables the drive signal.

An embodiment may include that the error detector circuit is configured to continue asserting the error detection signal for a second time period.

In an embodiment the error detector circuit may include a first comparator, for example comparator 79, configured to detect the drive signal being no less than a first value and responsively initiate forming the first time period.

An embodiment may include that the LED control circuit is configured to receive a single sense signal that is representative of a value of the LED current through the plurality of LED strings.

In an embodiment, the LED control circuit may be configured to receive a single sense signal that is representative of an average value of the LED current of all of the LED strings.

An embodiment of the LED control circuit may include a means for detecting an error to use a single sense signal to detect an open circuit in a path of the LED current or an open circuit in a path of the sense signal.

Those skilled in the art will appreciate that a method of forming an LED control circuit may comprise:

configuring the LED control circuit to receive a sense signal, such as signal SN for example, that is representative of a value of an LED current flow through a plurality of LED strings wherein each LED string includes a plurality of series coupled LEDs;

configuring a detector circuit, for example circuit 25, of the LED control circuit to detect the LED current being no greater than a first value and responsively initiate forming a first time period; and configuring the LED control circuit to inhibit forming the LED current responsively to termination of the first time period.

Another embodiment of the method may include configuring the LED control circuit to inhibit forming the LED current responsively to termination of the first time period includes configuring the LED control circuit to inhibit forming the LED current responsively to termination of the first time period and the LED current remaining no greater than the first value for the first time period.

In an embodiment, the method may include configuring the LED control circuit to receive a sense signal that is representative of a value of an LED current flow through a string of series coupled LEDs includes configuring the LED control circuit to regulate the LED current to a desired value in the absence of an error condition.

Those skilled in the art will also appreciate that a method of forming an LED control circuit may comprise:

configuring the LED control circuit to receive a sense signal (SN) that is representative of a value of an LED current flow through a plurality of LED strings wherein each LED string includes a plurality of series coupled LEDs; and configuring the LED control circuit to detect an error condition of one of the sense signal being no greater than a first value or a drive signal being greater than a second value, and assert an error signal responsively to a first time period expiring and the error condition remaining.

An embodiment may include configuring the LED control circuit to inhibit forming the LED current responsively to termination of the first time period.

In an embodiment, the method may include configuring the LED control circuit to detect one of a drive current or a drive voltage of the drive signal being no less than the first value.

An embodiment of the method may include configuring the LED control circuit to form the drive signal as a current to drive a base of a plurality of bipolar transistors with a first bipolar transistor coupled in series with a first LED string of the plurality of Led strings and a second bipolar transistor coupled in series with a second LED string of the plurality of LED strings.

One embodiment of the method may include configuring the LED control circuit to detect the error condition of one of the sense signal being no greater than the first value includes configuring LED control circuit to receive a single sense signal that is representative of the value of the LED current flow through the plurality of LED strings.

Another embodiment of the method may include configuring the LED control circuit to detect the error condition of one of the sense signal being no greater than the first value includes configuring LED control circuit to receive a single sense signal that is representative of the value of the LED current flow through the plurality of LED strings.

Although the drawings may illustrate typical or nominal values for some of the currents, voltages, reference voltages, time periods, and passive element values, those skilled in the art understand that these values are merely example values and that such values may be different in other embodiments.

Although the sense signal is described as becoming no greater than the first value and signal 52 or the DV signal is described as becoming no less than the second value, those skilled in the art will appreciate that the polarity of either or both of the sense signal and signal 52 or the DV signal may be reversed and that the associated detection point may also be reversed such as no greater than becoming no less than.

Those skilled in the art will appreciate that the number of LED strings illustrated in the drawings is merely an example number and more or less may be included in other embodiments. Additionally, the number of LEDs in each string of LEDs is also merely an example used to assist in explaining the operation. Thus, in other embodiments the number of LEDs in each string may be fewer or more than illustrated.

In view of all of the above, it is evident that a novel device and method is disclosed. Included, among other features, is forming an LED controller to detect an error conditions and multiple error conditions and responsively inhibit current flow through the plurality of LED strings. The circuit and detection methods facilitate using only one input pin on a semiconductor package for a sense (SN) signal that is used to detect the multiple error conditions. Using only one pin reduces the costs. Configuring one circuit, such as circuit 25 for example, to detect multiple different error conditions also minimizes the circuitry and reduces the costs.

While the subject matter of the descriptions are described with specific preferred embodiments and example embodiments, the foregoing drawings and descriptions thereof depict only typical and example embodiments of the subject matter and are not therefore to be considered to be limiting of its scope, it is evident that many alternatives and variations will be apparent to those skilled in the art.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. An LED control circuit comprising:

a control circuit configured to form a drive signal to control LED current through a plurality of LED strings;

an input to receive a sense signal that is representative of the LED current through the plurality of LED strings;

an error detector circuit configured to use the sense signal to detect the LED current being less than a desired value for a first time period; and the LED control circuit configured to inhibit the LED current responsively to the error detector circuit detecting the LED current being less than the desired value for the first time period.

2. The LED control circuit of claim 1 wherein the control circuit is configured to continue to inhibit the LED current until expiration of a second time period.

3. The LED control circuit of claim 2 wherein the error detector circuit is configured to form the second time period responsively to termination of the first time period.

4. The LED control circuit of claim 1 wherein the error detector circuit includes a first comparator configured to detect the sense signal being no greater than a first value and responsively initiate forming the first time period.

5. The LED control circuit of claim 4 wherein the first comparator initiates the first time period by selectively enabling a current source to charge a capacitor.

6. The LED control circuit of claim 4 wherein the error detector circuit includes a second comparator configured to detect the drive signal being no less than a second value and responsively initiate forming the first time period.

7. The LED control circuit of claim 1 wherein the error detector circuit detects the LED current being less than the desired value and responsively initiates forming the first time period, the error detector circuit configured to assert an error detection signal responsively to the LED current being less than the desired value for the first time period wherein the control circuit receives the error detection signal and responsively disables the drive signal.

8. The LED control circuit of claim 7 wherein the error detector circuit is configured to continue asserting the error detection signal for a second time period.

9. The LED control circuit of claim 1 wherein the error detector circuit includes a first comparator configured to detect the drive signal being no less than a first value and responsively initiate forming the first time period.

10. The LED control circuit of claim 1 including configuring the LED control circuit to receive a single sense signal that is representative of a value of the LED current through the plurality of LED strings.

11. The LED control circuit of claim 1 including configuring the LED control circuit to receive a single sense signal that is representative of an average value of the LED current of all of the LED strings.

12. The LED control circuit of claim 1 including a means for detecting an error to use a single sense signal to detect an open circuit in a path of the LED current or an open circuit in a path of the sense signal.

13. A method of forming an LED control circuit comprising:

configuring the LED control circuit to receive a sense signal that is representative of a value of an LED current flow through a plurality of LED strings wherein each LED string includes a plurality of series coupled LEDs;

configuring a detector circuit of the LED control circuit to detect the LED current being no greater than a first value and responsively initiate forming a first time period; and configuring the LED control circuit to inhibit forming the LED current responsively to termination of the first time period.

14. The method of claim 13 wherein configuring the LED control circuit to inhibit forming the LED current responsively to termination of the first time period includes configuring the LED control circuit to inhibit forming the LED current responsively to termination of the first time period and the LED current remaining no greater than the first value for the first time period.

15. The method of claim 13 wherein configuring the LED control circuit to receive a sense signal that is representative of a value of an LED current flow through a string of series coupled LEDs includes configuring the LED control circuit to regulate the LED current to a desired value in the absence of an error condition.

16. A method of forming an LED control circuit comprising:

configuring the LED control circuit to receive a sense signal that is representative of a value of an LED current flow through a plurality of LED strings wherein each LED string includes a plurality of series coupled LEDs; and configuring the LED control circuit to detect an error condition of one of the sense signal being no greater than a first value or a drive signal being greater than a second value, and assert an error signal responsively to a first time period expiring and the error condition remaining.

17. The method of claim 16 including configuring the LED control circuit to inhibit forming the LED current responsively to termination of the first time period.

18. The method of claim 16 including configuring the LED control circuit to detect one of a drive current or a drive voltage of the drive signal being no less than the first value.

19. The method of claim 16 including configuring the LED control circuit to form the drive signal as a current to drive a base of a plurality of bipolar transistors with a first bipolar transistor coupled in series with a first LED string of the plurality of Led strings and a second bipolar transistor coupled in series with a second LED string of the plurality of LED strings.

20. The method of claim 16 wherein configuring the LED control circuit to detect the error condition of one of the sense signal being no greater than the first value includes configuring LED control circuit to receive a single sense signal that is representative of the value of the LED current flow through the plurality of LED strings.

* * * * *